US010122078B2

(12) United States Patent
Hutcheson et al.

(10) Patent No.: US 10,122,078 B2
(45) Date of Patent: Nov. 6, 2018

(54) SURFACE WAVE ANTENNA USING GRADED DIELECTRIC MATERIAL

(71) Applicant: L-3 Communications Corporation, New York, NY (US)

(72) Inventors: George Zohn Hutcheson, Richardson, TX (US); Maurio Batista Grando, McKinney, TX (US)

(73) Assignee: L-3 Communications Corporation, New York, NY (US)

( * ) Notice: Subject to any disclaimer, the term of this patent is extended or adjusted under 35 U.S.C. 154(b) by 95 days.

(21) Appl. No.: 15/143,395

(22) Filed: Apr. 29, 2016

(65) Prior Publication Data

US 2018/0212317 A1 Jul. 26, 2018

Related U.S. Application Data

(60) Provisional application No. 62/194,175, filed on Jul. 17, 2015, provisional application No. 62/297,641, filed on Feb. 19, 2016.

(51) Int. Cl.

| | |
|---|---|
| ***H01Q 1/42*** | (2006.01) |
| ***H01Q 9/04*** | (2006.01) |
| ***H01Q 9/30*** | (2006.01) |

(52) U.S. Cl.

CPC ..... *H01Q 1/422* (2013.01); *H01Q 9/0428* (2013.01); *H01Q 9/0464* (2013.01); *H01Q 9/0492* (2013.01); *H01Q 9/30* (2013.01)

(58) Field of Classification Search

CPC ..... H01Q 1/42; H01Q 9/0428; H01Q 9/0464; H01Q 9/0492

USPC ..... 343/872

See application file for complete search history.

(56) References Cited

U.S. PATENT DOCUMENTS

| | | | | |
|---|---|---|---|---|
| 3,408,593 | A * | 10/1968 | Hurwitz, Jr. | H01S 3/101 359/302 |
| 4,689,629 | A * | 8/1987 | Traut | H01Q 13/28 343/770 |
| 5,784,507 | A * | 7/1998 | Holm-Kennedy | G01J 3/0259 250/227.23 |
| 8,736,502 | B1 | 5/2014 | Langfield et al. | |
| 9,628,116 | B2 * | 4/2017 | Henry | H01Q 13/02 |
| 2009/0174606 | A1 * | 7/2009 | Qian | H01Q 1/368 343/700 MS |

OTHER PUBLICATIONS

Zucker, "Surface Wave Antennas", Chapter 10, Antenna Engineering Handbook, 2007, 32 pgs.

(Continued)

*Primary Examiner* — Huedung Mancuso

(74) *Attorney, Agent, or Firm* — Egan Peterman Enders Huston

(57) ABSTRACT

A surface wave antenna system is presented. The surface wave antenna system is configured to be coupled to a surface and includes an antenna and a radiation modifier. The radiation modifier includes a material having a graded dielectric constant. A final portion of the radiation modifier includes material having a dielectric constant that produces a signal phase velocity in signals emitted from the radiation modifier that is substantially equal to a phase velocity of signals on the surface.

31 Claims, 4 Drawing Sheets

(56) References Cited

OTHER PUBLICATIONS

Chen et al., "Electromagnetic Optimal Design and Preparation of Broadband Ceramic Randome Material With Graded Porous Structure", Progress in Electromagnetics Research, vol. 105, pp. 445-461, 2010, 17 pgs.
Harrington, "Time Harmonic Electromagnetic Fields", Chapter 4, section 4-8 "Surface-guided Waves", pp. 168-171, IEEE Press Classic Reissue, 2001, 4 pgs.
Temes et al., "Introduction to Circuit Synthesis and Design", McGraw-Hill Book Company, 1977, 7 pgs.
Hayt, "Engineering Electro-Magnetics", Third Edition, McGraw-Hill Book Company, 1974, 6 pgs.
Balanis, "Advanced Engineering Electromagnetics", Second Edition, John Wiley & Sons, Inc., 2012, 5 pgs.
Induceramic.Com, "Porous Ceramics Thermal Insulation Application", Posted by web.archive.org with listed capture dated of Jun. 23, 2015 (Interactive Archive Wayback Machine), 3 pgs.

* cited by examiner (From F. Chen, Q. Shen, and L. Zhang, "Electromagnetic Optimal Design And Preparation Of Broadband Ceramic Radome Material With Graded Porous Structure", Progress In Electromagnetics Research, Vol. 105, 445-461, 2010)

SURFACE WAVE ANTENNA USING GRADED DIELECTRIC MATERIAL

The present application is related to U.S. Provisional Patent No. 62/194,175, filed Jul. 17, 2015, entitled "CONFORMAL ANTENNA USING GRADED POROUS CERAMICS" and to U.S. Provisional Patent No. 62/297,641, filed Feb. 19, 2016, entitled "CONFORMAL ANTENNA USING GRADED POROUS CERAMICS". Provisional Patents No. 62/194,175 and 62/297,641 are assigned to the assignee of the present application and are hereby incorporated by reference into the present application as if fully set forth herein. The present application hereby claims priority under 35 U.S.C. § 119(e) to U.S. Provisional Patents No. 62/194,175 and 62/297,641.

TECHNICAL FIELD

The present application relates generally to conformal antennas and, more specifically, to a surface wave antenna using graded dielectric material.

BACKGROUND

Many vehicles (including, but not limited to, missiles, space craft, aircraft, trucks, and automobiles) require an antenna with forward-directed gain, that is, gain that is maximum in the direction of travel. In such vehicles the nose of the vehicle would be the most desirable location for the antenna. However, the nose of the vehicle may be occupied by other equipment, or may be covered by materials that are not transparent to electromagnetic (EM) radiation. Such materials may be required to resist heat caused by high-speed motion, or to protect the vehicle in the event of a collision. In such vehicles, it may not be possible to locate the antenna in the nose, where the antenna could achieve maximum forward directed gain.

Even where the antenna gain is directed in a direction other than the direction of travel, the portion of the vehicle facing in the desired direction of propagation may not be available or suitable for locating an antenna.

As shown in the graph depicted in FIG. 1, aerodynamic friction can cause the skin temperature of high-velocity vehicles to reach ultra-high temperatures (>500° C.). An antenna is often covered by a structure called a radome, to protect the antenna from materials in the surrounding atmosphere. Radomes are preferably fabricated from non-conductive, low-loss materials, to provide for effective propagation of EM radiation.

Where a radome is located on or in the skin of a vehicle, the material of the radome will be subjected to the high temperatures discussed above. Many materials that are suitable for antenna radomes cannot withstand the high temperatures seen during hypersonic flight.

In addition, in some vehicles it is desirable for antenna and radome to be conformal to a surface of the vehicle's wings or fuselage without protruding into the air stream, and to be able to radiate in directions other than normal to that surface.

Technical aspects of surface wave antennas and radomes are described in the following references, which are incorporated in this disclosure by reference as if fully set forth herein:

1) F. Chen, Q. Shen, and L. Zhang, "Electromagnetic Optimal Design And Preparation Of Broadband Ceramic Radome Material With Graded Porous Structure", Progress In Electromagnetics Research, Vol. 105, 445-461, 2010.
2) F. J. Zucker, "Surface Wave Antennas," Antenna Engineering Handbook, McGraw-Hill Companies, 2007.
3) J. Langfield, J. T. Mehr, D. J. Carlson, "Conformal Wide Band Surface Wave Radiating Element", U.S. Pat. No. 8,736,502.
4) R. F. Harrington, Time-Harmonic Electromagnetic Fields, John Wiley & sons, 2001.

SUMMARY

In one aspect, a surface wave antenna system is configured to be coupled to a surface and includes an antenna and a radiation modifier. The radiation modifier includes a material having a graded dielectric constant. A final portion of the radiation modifier includes material having a dielectric constant that produces a signal phase velocity in signals emitted from the radiation modifier that is substantially equal to a phase velocity of signals on the surface.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
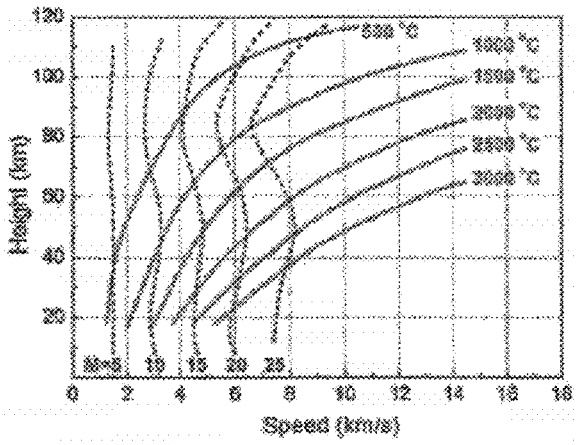
FIG. 1 presents a graph of vehicle skin temperature as a function of vehicle flight speed and flight height.
Figure 2:
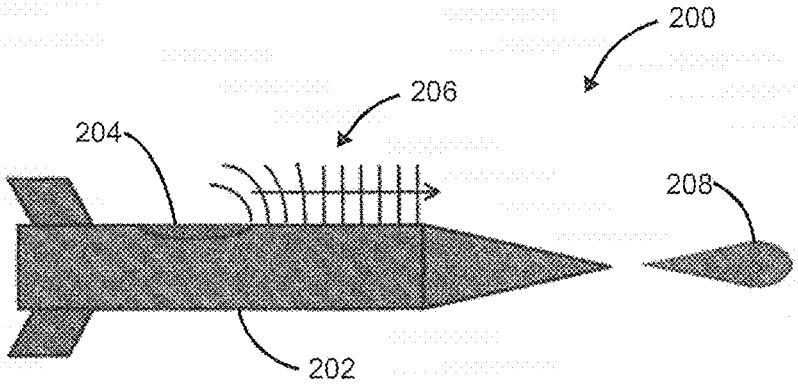
FIG. 2 illustrates signal propagation from a vehicle having an antenna system according to one embodiment of the disclosure.

FIGS. 1 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged surface wave antenna using graded dielectric material.

Embodiments of the disclosure provide a class of antennas that utilize materials having spatially graded dielectric constants to provide improved propagation of electromagnetic (EM) surface waves in a direction perpendicular to the normal vector of a surface of the antenna aperture. Antennas flush mounted to vehicle bodies (i.e., conformal antennas) may thus provide radiation patterns that are largely directed to or from the nose of the vehicle, or in another desired direction from the vehicle.

Embodiments of the disclosure provide a method for constructing high temperature wide-band conformal antennas for hypersonic missiles, hypersonic aircraft and other high speed vehicles (such as projectiles), for space vehicles while passing through the atmosphere, as well as for other, lower-speed vehicles. An antenna dielectric according to the disclosure is constructed of a porous ceramic material (in some embodiments, silicon nitride (Si3N4)) with a graded index of refraction, which provides high gain in the direction of vehicle travel, but also provides resistance to the high temperatures of supersonic or hypersonic speeds. The dielectric constant of silicon nitride may be controlled by controlling its porosity. The lower the porosity, the higher the dielectric constant. Embodiments of the disclosure provide advantages for radars, sensors, and communication equipment placed in missiles and other hypersonic platforms, as well as for other lower-speed vehicles.

Antennas and radomes flush mounted within the side of a vehicle and away from the vehicle's nose provide a flexible physical configuration for many hypersonic (and subsonic) platforms. Such antennas and radomes are also beneficial for other types of vehicles, including airplanes and space vehicles. Such antennas and radomes are also beneficial for radiating EM signals from the vehicle in other directions.

For example, to provide acceptable antenna gain in the direction of forward flight path (and in the direction parallel to the missile skin and the antenna radome surface), EM surface waves that propagate along the missile body are launched from the antenna towards the missile nose. These surface waves radiate into space as they progress along the missile body. Any remaining wave energy at the nose is radiated by the nose itself Such propagation and radiation are shown in the system 200 according to the disclosure depicted in FIG. 2. A vehicle 202 includes a conformal antenna 204. EM surface waves 206 radiated from the antenna 204 propagate along the body of the vehicle 202 and radiate into space as they propagate. When the EM waves 206 reach the nose of the vehicle 202, remaining EM energy 208 is radiated from the nose of the vehicle 202.

Surface waves are launched from an antenna onto a surface of a vehicle more efficiently if the phase velocity of the waves out of the antenna match or nearly match the phase velocity of vehicle body surface waves that provide a desired antenna gain. The phase velocity of EM waves radiated by an antenna is dependent upon the dielectric constant of materials within the antenna.

Further, the degree to which surface waves radiated by an antenna are initially formed and bound to the vehicle surface, is affected by the dielectric within the antenna and materials on the surface of the missile. Limited availability of materials with desired dielectric properties makes the design of conformal antennas difficult in some circumstances. Additionally, the high temperatures experienced on the surface of hypersonic vehicles further limits the available dielectric materials that may effectively launch surface waves.

Some embodiments of the disclosure use porous ceramic materials to achieve an engineered dielectric constant that facilitates the formation and propagation of surface waves from an antenna to the surface of a vehicle body. Such embodiments may be used in high temperature applications. Other embodiments may use other materials having desired dielectric constants.

In some embodiments, the dielectric constant is varied or graded along one or more dimensions in order to achieve a specific spatial variation in dielectric constant that best promotes the propagation of the desired surface waves and the best forward directed antenna gain.

Figure 3:
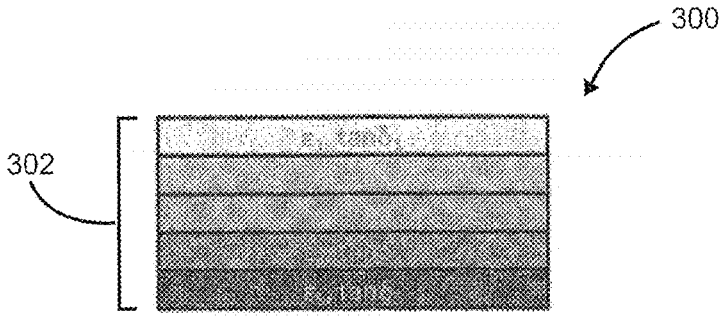
FIG. 3 depicts a radiation modifier according to one embodiment of the disclosure.

FIG. 3 depicts a radiation modifier 300 according to the disclosure. Horizontal layers 302 of material having differing dielectric constants are combined to form the radiation modifier 300 having a dielectric constant that is graded in the vertical dimension (as shown in FIG. 3). The degree to which the dielectric constant of the radiation modifier 300 is varied provides a method of controlling the phase velocity and the transverse attenuation (or bounding) of surface waves launched by an antenna.

While radiation modifier 300 is an embodiment having layers of equal thickness, in other embodiments the layers may be of unequal thickness. Where the materials of the layers 302 have dielectric constants determined by the type of material or a characteristic of its fabrication, the designer of a radiation modifier according to the disclosure may select layers of differing thicknesses to adapt to large (or small) differences in dielectric constant between adjacent layers of material.

While radiation modifier 300 comprises five layers of materials having differing dielectric constants, other embodiments may comprise more or fewer layers of material. While radiation modifier 300 has discrete layers of material having differing dielectric constants, in other embodiments the material of the radiation modifier 300 may comprise one or more materials having a dielectric constant that varies (or is gradated) continuously along one or more dimensions.

Figure 4:
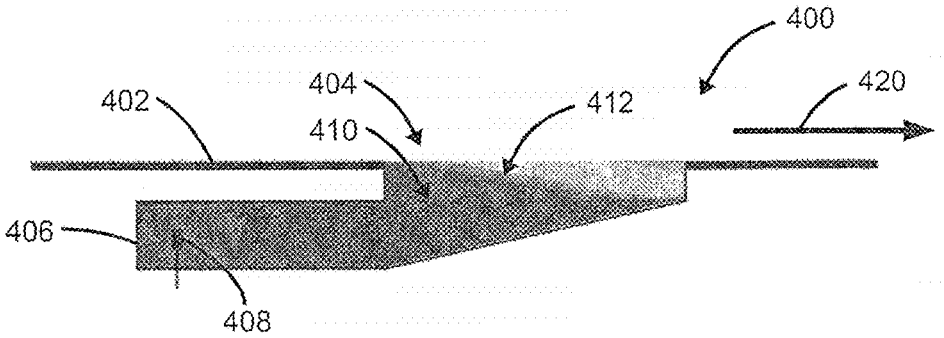
FIG. 4 illustrates a cutaway side view of a conformal surface wave antenna system according to one embodiment of the disclosure.

FIG. 4 illustrates a cutaway side view of a conformal surface wave antenna system 400 according to the disclosure. A skin 402 (or outer surface) of a vehicle includes an aperture 404. An arrow 420 indicates a desired direction of propagation for signals emitted by the antenna system 400.

Within the vehicle skin 402, the antenna system 400 includes a waveguide 406 that includes an antenna 408. The waveguide 406 has a tapered profile that imparts at least some directionality (or gain) to the radiation emissions from the antenna system 400 in the desired direction of propagation 420. The antenna 408 may act as a signal radiator, as a signal receiver, or as both simultaneously.

The antennas system 400 is a type of antenna referred to as a waveguide with open broad wall. As will be described below with reference to FIGS. 6A-8, in other embodiments radiation modifiers according to the disclosure may be utilized with antennas of other types.

The conformal surface wave antenna system 400 includes a radiation modifier 412 according to the disclosure that extends from an exit aperture 410 of the waveguide 406 to the aperture 404 in the vehicle skin 402. The radiation modifier 412 has a dielectric constant profile that varies continuously in two dimensions: both in the direction from the waveguide 406 to the vehicle skin 402, and in the direction of the desired propagation 420.

The waveguide 406 is filled with material having a desired dielectric constant. In other embodiments, the waveguide may be hollow. In still other embodiments, the radiation modifier 412 may extend past the waveguide exit aperture 410 a desired distance into the waveguide 406. In some such embodiments, the the radiation modifier 412 may extend all the way to the antenna 408.

The dielectric constant of the material of the radiation modifier 412 adjacent to the waveguide exit aperture 410 (or closest to the antenna 408 ) may be selected or designed according to the phase velocity of signals within the waveguide 406. This portion of the radiation modifier 412 may be referred to as the initial layer or initial portion of the radiation modifier 412. One benefit of such a design choice is to improve coupling of signals between the waveguide 406 and the radiation modifier 412. Another benefit is to reduce signal reflections from the surface of the radiation modifier 412 as the signal passes from the waveguide 406 into the radiation modifier 412 (or vice versa). Similarly, where the radiation modifier includes layers of material, the dielectric constants of succeeding layers may be selected to reduce reflections from the layers' surfaces.

The dielectric constants of the remaining layers (or the gradated dielectric constant of the remaining material) in the radiation modifier 412 is preferably selected to provide a desired phase velocity of radiation emitted from the radiation modifier 412. Radiation that is emitted at or above the speed of light in the medium surrounding the vehicle (e.g., $3.0\times10^8$ meters/second (m/s) in a vacuum, or $2.981\times10^8$ m/s in air) is coupled less efficiently to surface waves on the surface of the vehicle—that is, a greater portion of the emitted radiation radiates away from the surface, rather than along the surface. Thus, preferably, the dielectric constants of the remaining layers of the radiation modifier 412 are chosen to give the emitted radiation a phase velocity that is less than the speed of light in the medium surrounding the vehicle (or the medium adjacent to the portion of the radiation modifier 412 from which radiation is emitted, i.e., the aperture 404 ).

Utilizing materials having such dielectric constants results in greater coupling of the signals emitted by the antenna system 400 to surface waves on the vehicle skin 402, as well as reducing signals emitted in directions other than desired direction of propagation 420. Utilizing such materials also improves the gain of the antenna system 400 in the desired direction of propagation 420.

Figure 5:
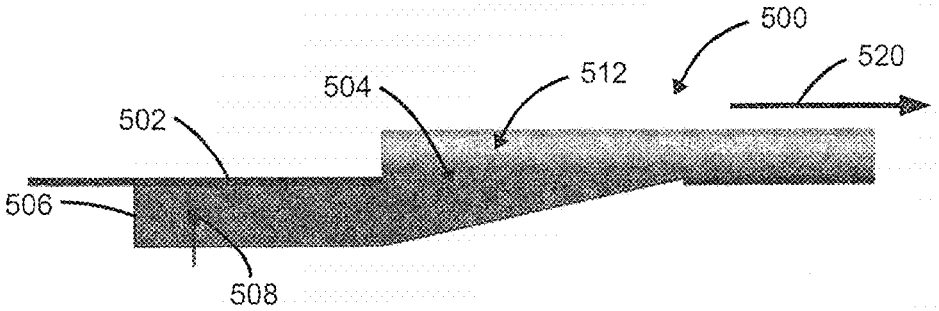
FIG. 5 depicts a cutaway side view of a surface wave antenna system according to one embodiment of the disclosure that extends external to the body of a vehicle.

FIG. 5 depicts a cutaway side view of a surface wave antenna system 500 according to the disclosure that extends external to the body of a vehicle. A waveguide 506 that includes a feed 508 has an exit aperture substantially coincident with an aperture 504 in a skin 502 of the vehicle. A radiation modifier 512 is located external to the skin 502 and covering the aperture 504. The dielectric constant of the radiation modifier 512 varies continuously in a direction normal to the surface of the vehicle skin 502. In the embodiment shown in FIG. 5, the radiation modifier 512 extends along the skin 502 beyond the aperture 504 in the desired direction of propagation 520.

Because the radiation modifier 512 is located external to the skin 502, the antenna system 500 is not characterized as a conformal antenna. However, the radiation modifier 512 acts as a dielectric waveguide, improves wave binding to the surface of the vehicle, and improves the gain of the antenna system 500 in the desired direction of propagation 520. Where the radiation modifier 512 is fabricated from ceramic materials, it may also provide thermal protection to the vehicle skin 502. In other embodiments, a portion of the radiation modifier 512 may extend into the waveguide 506.

Figure 9:
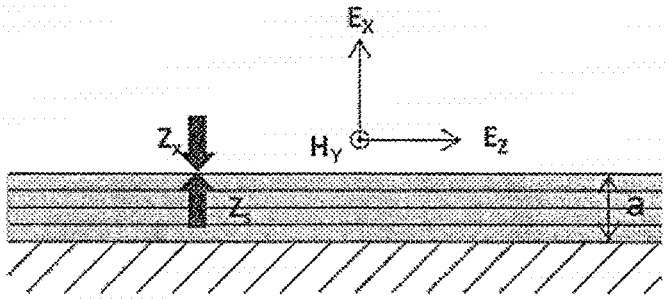
FIG. 9 illustrates conditions for a surface wave traveling on a metal surface covered by a graded dielectric according to one embodiment of the disclosure.

The degree to which the surface waves are bounded to a graded dielectric surface can be determined from solutions of the electromagnetic wave equation. Consider the conditions illustrated in FIG. 9 for a surface wave traveling on a metal surface covered by a graded dielectric. The graded dielectric is shown as discrete layers stacked in the x direction. Above the graded dielectric layers is free space (air or vacuum). The surface wave travels in the +z direction. The electric ($E_x$, and $E_z$) and magnetic ($H_y$) field vector directions are shown for a transverse-magnetic (TM) wave. In order to simplify the description of the waves, the y dependence of the solutions to the wave equation are neglected since the geometry extends infinitely in the +/−y directions.

The electromagnetic field components of the surface wave in the space above the graded dielectric are:

$$E_z(x, z, t) = -A\frac{1}{j\omega\epsilon_o}\alpha_x^2 e^{-\alpha_x x}e^{-j\beta_z z}e^{j\omega t} \tag{1}$$

$$E_x(x, z, t) = A\frac{\beta_z}{\omega\epsilon_o}\alpha_x e^{-\alpha_x x}e^{-j\beta_z z}e^{j\omega t} \tag{2}$$

$$H_y(x, z, t) = -A\alpha_x e^{-\alpha_x x}e^{-j\beta_z z}e^{j\omega t} \tag{3}$$

where A is a constant, $\omega$ is the radial frequency, $\beta_z$ is the phase constant in the z direction, $\alpha_x$ is the attenuation constant in the x direction, and $\varepsilon_o$ is the permittivity of free space. The phase constant, $\beta_z$, quantifies the change in phase with distance in the +z direction, and the attenuation constant, $\alpha_x$, quantifies the amplitude loss with distance in the +x direction.

These equations (Eq. 1 to 3) show that the surface wave travels in the +z direction parallel to the metal surface. The equations also show that the wave decays exponentially in the +x direction with strongest fields at the surface where vacuum/air meets the graded dielectric. If the attenuation constant is large, the surface wave is "tightly bound" to the surface, and if the attenuation constant is small, the surface wave is "loosely bound" to the surface and may radiate prematurely. Tightly bound surface waves are desirable since such waves will propagate along the platform body to the location where the wave is launched best forward directed gain.

The attenuation constant, $\alpha_x$, is dependent on the surface impedance, $Z_x$, looking straight down onto the interface between the graded dielectric and vacuum/air. The downward surface impedance for the TM mode in the framework of the illustration above given by:

$$Z_x = \frac{E_z(\alpha, z, t)}{H_y(\alpha, z, t)} \tag{4}$$

where a is the x-axis location of the top surface of the graded dielectric surface.

Using the expressions for the field components (Eq. 2 and 3), this surface impedance is given by:

$$Z_x = j\frac{\alpha_x}{\omega\epsilon_o} \tag{5}$$

The transverse resonance condition requires that the impedance looking straight up from the graded dielectric to vacuum/air interface, $Z_s$, and the downward directed surface impedance, $Z_x$, are related by the expression:

$$0 = Z_x + Z_s \tag{6}$$

Combining equations 5 and 6:

$$Z_s = -j\frac{\alpha_x}{\omega\epsilon_o} \tag{7}$$

or:

$$\alpha_x = X_s\omega\epsilon_o \tag{8}$$

where $X_s$ is the imaginary part or reactive part of $Z_s$. This last expression indicates that the strength with which the wave is bound to the surface is controlled by the reactance of the surface impedance, $X_s$. Large reactance binds the wave to the surface and guides the wave along the body of the platform which directs the antenna radiation in the forward direction.

The surface impedance viewed downward, $Z_x$, may be approximated by the impedance of a TEM wave traveling in the −x direction. The impedance at each boundary or interface between layers in the graded dielectric having N layers may be given by the following expressions:

$$Z_x = \eta_1\frac{Z_2 + j\eta_1\tan(\beta_{x_1}d_1)}{\eta_1 + jZ_2\tan(\beta_{x_1}d_1)} \tag{9}$$

$$Z_2 = \eta_2\frac{Z_3 + j\eta_2\tan(\beta_{x_2}d_2)}{\eta_2 + jZ_3\tan(\beta_{x_2}d_2)}; \tag{10}$$

$$Z_n = \eta_n\frac{Z_{n+1} + j\eta_n\tan(\beta_{x_n}d_n)}{\eta_n + jZ_{n+1}\tan(\beta_{x_n}d_n)}; \tag{11}$$

$$Z_N = j\eta_N\tan(\beta_{x_N}d_N) \tag{12}$$

where n is the number or index of the layers, $\eta_n$ is the wave impedance in the nth layer of the graded dielectric, $Z_n$ is the impedance at the interface between the n−1 and nth layers, $\beta_{x_n}$ is the phase constant along the x direction in the medium of the nth layer, and $d_n$ is the thickness of the nth layer. Note that the index, n, increases in the −x direction starting at the top the stack of dielectric layers and running to the bottom of the stack. The expression (Eq. 12) for the surface impedance at the interface to the next-to-last and bottom layer, $Z_N$, has a different form from the other expressions since the impedance of the metal surface at the bottom of the last layer is zero. These equations (Eq. 9 to 12) show that surface impedance at each boundary or interface, n, is dependent upon the surface impedance of the next (or deeper) interface, n+1. The impedance at the interface between vacuum/air and the top layer of the graded dielectric may be found from these equations in an iterative fashion where the impedance at the deepest interface (N) is used to find the impedance at higher interfaces until the impedance at the top surface, $Z_x$, is determined.

Since equations 9 through 12 do not give a simple closed form expression for $Z_x$, numerical optimization methods may be used to maximizing the reactance or imaginary part of the surface impedance, $Z_x$. Alternatively, the reactance may be maximized by approximating the discrete dielectric layers as a series of transmission lines connected in cascade. Combinations of two-port network parameters (e.g., Z, ABCD, S, etc.) for distributed elements may then be used to simplify the surface impedance, $Z_x$, to a closed form (but complicated) expression that may then be optimized analytically for maximum reactance.

The bandwidth of graded dielectric surfaces over which surface waves are tightly bound to the guiding surface may be optimized using the techniques for wide-band impedance equalizers and filters when the graded dielectric surface is approximated as transmission lines or distributed circuit elements. With such techniques, the bandwidth of graded dielectric surfaces may be made greater than the bandwidth of other surface waveguide methods (e.g. single dielectric layer surface waveguides).

Although transverse-magnetic (TM) waves are presented above, the same analysis may be used for transverse-electric (TE) waves with appropriate change of variables.

Graded dielectrics may be formed in several ways and from several materials, including (but not limited to) the following.

First, multiple discrete layers of hydrocarbon or organic based materials may be laminated or bonded, with each layer having a different dielectric constant. Non-limiting examples include:

- Polytetrafluoroethylene (PTFE) with additives to control dielectric constant;
- PTFE with ceramic particles added for control of dielectric constant;
- Resin or epoxy with glass fiber content, ceramic particles, or other additives suitable for controlling dielectric constant; and
- Other hydrocarbons with or without ceramic particle added for control of dielectric constant (e.g., TMM thermoset laminates made by Rogers Corporation of Rogers, Conn.).

Second, multiple ceramic layers of different dielectric constants may be sintered. Such ceramic may include porous ceramic materials where the degree of porosity is used to control the dielectric constant. Suitable ceramic materials include (but are not limited to) Silicon Nitride ($Si_3N_4$), Aluminum Oxide (or Alumina, $Al_2O_3$), Cordierite, Zirconium Oxide ($ZrO_2$), Sintered Silicon Carbide (S-SiC), and Clay-bound Silicon Carbide (CB-SiC). High temperature resistance is provided by the natural refractory characteristics of such porous ceramic materials.

Third, fabrication techniques providing continuous or nearly continuous variation in dielectric constant may be used with suitable organic or refractory materials. Such fabrication techniques include (but are not limited to) stereolithography, selective laser sintering, and fused deposition modeling.

Figure 6A:
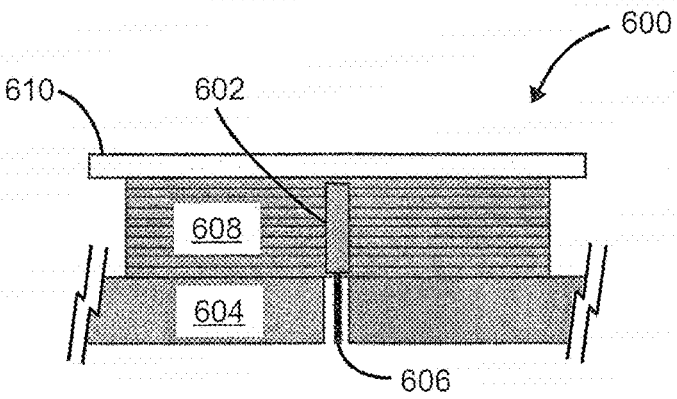
FIGS. 6A and 6B present a cutaway side view and a cutaway top view, respectively, of an omnidirectional surface wave antenna system according to one embodiment of the disclosure.
Figure 6B:
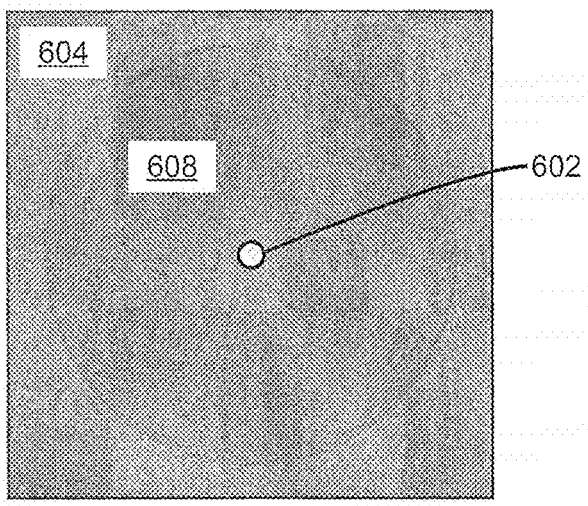

FIGS. 6A and 6B illustrate an omnidirectional surface wave antenna system 600 according to the disclosure. FIG. 6A presents a cutaway side view and FIG. 6B presents a cutaway top view of the antenna system 600. The antenna system 600 includes a monopole antenna 602 mounted on a ground plane 604. The monopole antenna 602 is electrically coupled to RF electronics (not shown) via a feed conductor 606. The monopole antenna 602 is located within a cylindrical radiation modifier 608 according to the disclosure.

The antenna system 600 further includes a radome 610 located on an outer surface. The radome 610 may comprise a material providing high temperature protection of the components of the antenna system 600. In some embodiments, the radome 610 comprises a material providing high temperature protection for the components of the antenna system 600. In some such embodiments, the radome 610 comprises a metal having a high melting point, such as tungsten or titanium. The radome 610 is an optional component and may be omitted from embodiments operating at lower temperatures.

As described for the antenna systems described with reference to FIGS. 3 and 5, the radiation modifier 608 comprises a plurality of horizontal layers having differing dielectric constants. The radiation modifier 608 is adapted to transform a phase velocity of signals emitted from the monopole antenna 602 and emit signals having a phase velocity more closely matched to the phase velocity of surface waves on the surface of the ground plane 604. In this way, signals emitted from the antenna system 600 are more efficiently coupled to radiate as surface waves along the ground plane 604.

Figure 7:
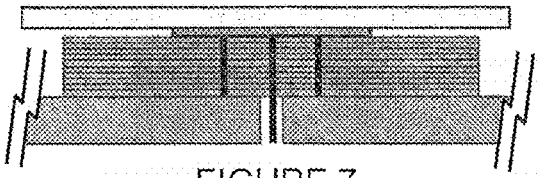
FIG. 7 illustrates a cut away side view of a higher mode circular patch surface wave antenna according to one embodiment of the disclosure.
Figure 8:
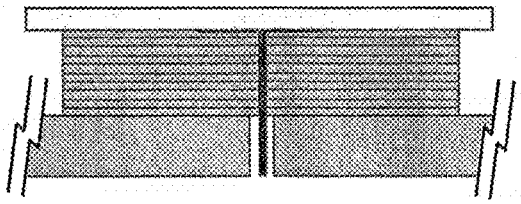
FIG. 8 illustrates a cut away side view of a monopole surface wave antenna with top hat according to one embodiment of the disclosure.

FIG. 7 illustrates a cut away side view of a higher mode circular patch surface wave antenna according to the disclosure. FIG. 8 illustrates a cut away side view of a monopole surface wave antenna with top hat according to the disclosure. FIGS. 7 and 8 show radomes similar to the radome described with reference to FIG. 6A. As described for the radome of FIG. 6A, the radomes of FIGS. 7 and 8 are optional components and, in some embodiments, may comprise a metal having a high melting point.

In some embodiments of antenna systems according to the disclosure as shown in FIGS. 6A-8, a radiation modifier may have a dielectric constant that varies in concentric layers (or continuously) radially from the monopole antenna 602 outwards to the perimeter of the antenna system. In other embodiments, the dielectric constant of the cylindrical radiation modifier may vary in two dimensions: both radially and from one end of the cylinder to the other end of the cylinder. In such embodiments, the radiation modifier may be formed as nested conical layers of material.

Discussion in this disclosure of transmission of EM radiation applies to the reception of EM radiation, as well. While the disclosure discusses launching radiation onto the surface of a vehicle, in other embodiments, surface wave antennas according to the disclosure may launch surface waves onto a surface of a static structure. While the disclosure discusses launching surface wave radiation onto the outer surface of a vehicle, in other embodiments, surface wave antennas according to the disclosure may launch surface waves onto an inner surface of a structure (including a vehicle or static structure).

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A surface wave antenna system configured to be coupled to a surface, comprising:

an antenna; and a radiation modifier comprising a material having a graded dielectric constant, where the graded dielectric constant of the material reduces signals emitted from or received by the antenna system in directions other than a desired direction of propagation and increases the gain of the antenna system in the desired direction of propagation, wherein a final portion of the radiation modifier comprises material having a dielectric constant that produces a desired phase velocity in signals emitted from or received by the radiation modifier.

2. The surface wave antenna system of claim 1, wherein the radiation modifier is configured as a high temperature radome.

3. The surface wave antenna system of claim 1, wherein the radiation modifier comprises a plurality of layers of materials, each material having a differing dielectric constant.

4. The surface wave antenna system of claim 3, wherein at least some of the plurality of layers comprise silicon nitride, each such layer having a differing porosity.

5. The surface wave antenna system of claim 1, wherein the radiation modifier has a dielectric constant that varies along more than one dimension.

6. The surface wave antenna system of claim 1, wherein the phase velocity of signals emitted by the radiation modifier is less than the speed of light in a medium adjacent to a portion of the radiation modifier from which the signals are emitted.

7. A surface wave antenna system configured to be coupled to a surface, comprising:

an antenna; and a radiation modifier comprising a material having a graded dielectric constant, wherein a final portion of the radiation modifier comprises material having a dielectric constant that produces a desired phase velocity in signals emitted from the radiation modifier:

wherein an initial portion of the radiation modifier comprises material having a dielectric constant that reduces reflections from the surface of the initial portion of signals emitting from the antenna and entering the radiation modifier.

8. The surface wave antenna system of claim 1, wherein the antenna is one of a waveguide with open broad wall, a monopole antenna, a circular patch antenna, and a monopole antenna with top hat.

9. The surface wave antenna system of claim 1, wherein the antenna is a doorstop antenna and the radiation modifier is located between an exit aperture of the antenna and a surface aperture of the surface, the surface wave antenna system comprising a conformal antenna system.

10. A radiation modifier configured to be used with an antenna as part of an antenna system and to be coupled to a surface, the radiation modifier comprising a material having a graded dielectric constant, where the graded dielectric constant of the material reduces signals emitted from or received by the antenna system in directions other than a desired direction of propagation and increases the gain of the antenna system in the desired direction of propagation, and wherein a final portion of the radiation modifier comprises material having a dielectric constant that produces a desired phase velocity in signals emitted from the radiation modifier.

11. The radiation modifier of claim 10, wherein the radiation modifier is configured as a high temperature radome for the antenna.

12. The radiation modifier of claim 10, wherein the radiation modifier comprises a plurality of layers of materials, each material having a differing dielectric constant.

13. The radiation modifier of claim 12, wherein at least some of the plurality of layers comprise a porous ceramic material, each such layer having a differing porosity.

14. The radiation modifier of claim 10, wherein the radiation modifier has a dielectric constant that varies along more than one dimension.

15. The radiation modifier of claim 10, wherein the signal phase velocity of signals emitted by the radiation modifier is less than the speed of light in a medium adjacent to a portion of the radiation modifier from which the signals are emitted.

16. The radiation modifier of claim 10, wherein an initial portion of the radiation modifier comprises material having a dielectric constant that is based on the signal phase velocity of signals received from the antenna.

17. The radiation modifier of claim 10, wherein the radiation modifier is configured for use in one of one of a waveguide with open broad wall, a monopole antenna, a circular patch antenna, and a monopole antenna with top hat.

18. The radiation modifier of claim 10, wherein the radiation modifier is configured as a cylinder and the dielectric constant is graded radially from a center line of the cylinder to a perimeter of the cylinder of the radiation modifier.

19. The radiation modifier of claim 18, wherein the radiation modifier comprises a plurality of concentric cylindrical layers of materials, each material having a differing dielectric constant.

20. The radiation modifier of claim 18, wherein the dielectric constant is further graded from one end of the cylinder to the other end of the cylinder.

21. The surface wave antenna system of claim 1, wherein the radiation modifier is located between an exit aperture of the antenna and a surface aperture of the surface; and where the radiation modifier comprises a material having a spatially graded dielectric constant with a tapered profile that varies in at least two dimensions both in a direction from the antenna to the surface and in a different direction to increase propagation of electromagnetic (EM) surface waves in a desired direction of propagation.

22. The surface wave antenna system of claim 1, wherein the radiation modifier is located between an exit aperture of the antenna and a surface aperture of the surface; wherein the surface comprises a skin of a side of a vehicle having a nose oriented to face the direction of travel of the vehicle and the skin facing a different direction than the nose of the vehicle; and where the radiation modifier comprises a material having a spatially graded dielectric constant with a tapered profile that varies in at least two dimensions both in a direction from the antenna to the skin and in a different direction to increase propagation of electromagnetic (EM) surface waves in a direction toward the nose of the vehicle.

23. The surface wave antenna system of claim 1, wherein an exit aperture of the antenna is located adjacent a surface aperture of the surface; wherein the radiation modifier is located external to the surface; wherein the dielectric constant of the radiation modifier varies continuously in a direction normal to the surface to increase propagation of electromagnetic (EM) surface waves in a direction perpendicular to a normal vector of the surface.

24. The surface wave antenna system of claim 23, wherein the surface comprises a skin of a vehicle; wherein the radiation modifier is located external to the vehicle skin and extends as a dielectric waveguide along the skin of the vehicle beyond the surface aperture and in a desired direction of signal propagation to increase the gain of the antenna system in the desired direction of propagation.

25. The surface wave antenna system of claim 24, wherein the vehicle has a nose oriented to face the direction of travel of the vehicle; wherein the radiation modifier extends as a dielectric waveguide along the outside of the skin of the vehicle beyond the surface aperture and in a direction of signal propagation toward the nose of the vehicle to increase the gain of the antenna system in the direction of propagation toward the nose of the vehicle.

26. The surface wave antenna system of claim 25, the radiation modifier comprises porous ceramic material that provide thermal protection to the vehicle skin.

27. The surface wave antenna system of claim 1, wherein a final portion of the radiation modifier comprises material having a dielectric constant that produces a signal phase velocity in signals emitted from or received by the radiation modifier that is equal to a phase velocity of signals on the surface.

28. The surface wave antenna system of claim 1, wherein the radiation modifier comprises a plurality of layers of materials, each material having a differing dielectric constant, and two or more of the layers having a different thickness from each other.

29. A method, comprising:

emitting or receiving signals of desired phase velocity from a final portion of a radiation modifier of a surface wave antenna system that is coupled to a surface, the final portion of the radiation modifier comprising a material having a dielectric constant producing a desired phase velocity in the emitted or received signals, and the radiation modifier being coupled between an antenna and the surface; and where the radiation modifier comprises a material having a graded dielectric constant that reduces signals emitted from or received by the antenna system in directions other than a desired direction of propagation and increases the gain of the antenna system in the desired direction of propagation.

30. The method of claim 29, wherein the radiation modifier is located between an exit aperture of the antenna and a surface aperture of the surface, the surface comprising a skin of a vehicle having a nose; and where the method further comprises:

moving the vehicle in a direction of travel with the vehicle nose oriented to face the direction of travel of the vehicle and the skin facing a different direction than the nose of the vehicle; and where the radiation modifier comprises a material having a spatially graded dielectric constant with a tapered profile that varies in at least two dimensions both in a direction from the antenna to the skin and in a different direction to increase propagation of electromagnetic (EM) surface waves in a direction toward the nose of the vehicle.

31. The method of claim 30, wherein an exit aperture of the antenna is located adjacent a surface aperture of the vehicle skin; wherein the radiation modifier is located external to the vehicle skin; wherein the dielectric constant of the radiation modifier varies continuously in a direction normal to the surface to increase propagation of electromagnetic (EM) surface waves in a direction perpendicular to a normal vector of the skin; and where the radiation modifier is located external to the vehicle skin and extends as a dielectric waveguide along the outside of the skin of the vehicle beyond the surface aperture and in a direction of signal propagation toward the nose of the vehicle to increase the gain of the antenna system in the direction of propagation toward the nose of the vehicle.

* * * * *